US005775250A

United States Patent [19]

Kobayashi et al.

[11] Patent Number: 5,775,250

[45] Date of Patent: Jul. 7, 1998

[54] WATERCRAFT

[75] Inventors: Noboru Kobayashi; Toshiyuki Hattori, both of Iwata, Japan

[73] Assignee: Yamaha Hatsudoki Kabushiki Kaisha, Iwata, Japan

[21] Appl. No.: 722,599

[22] Filed: Jun. 27, 1991

[30] Foreign Application Priority Data

Jul. 2, 1990 [JP] Japan ..... 2-175592

[51] Int. Cl.[6] ..... B63B 35/44

[52] U.S. Cl. ..... 114/258

[58] Field of Search ..... 114/258, 259, 114/263, 248, 363; 441/126

[56] References Cited

U.S. PATENT DOCUMENTS

| | | | |
|---|---|---|---|
| 2,623,574 | 12/1952 | Damsch | 441/126 |
| 2,744,483 | 5/1956 | Rhindress | 114/263 |
| 3,347,201 | 10/1967 | Szabo . | |
| 3,565,486 | 2/1971 | Channon | 441/126 |
| 3,569,546 | 3/1971 | Miklos | 114/235 R |
| 3,659,546 | 5/1972 | Miklos | 114/263 |
| 3,776,167 | 12/1973 | Marbury, Jr. | 114/259 |
| 3,815,541 | 6/1974 | Hansen | 114/235 R |
| 3,858,541 | 1/1975 | Metcalf . | |
| 3,865,062 | 2/1975 | Bubb | 114/259 |
| 4,437,841 | 3/1984 | Stallman | 440/42 |
| 4,945,852 | 8/1990 | Kobayashi | 114/363 |
| 5,022,987 | 6/1991 | Wells | 210/173 |
| 5,131,348 | 7/1992 | Roy | 114/363 |

FOREIGN PATENT DOCUMENTS

| | | |
|---|---|---|
| 63-119198 | 8/1988 | Japan . |
| 2046689 | 4/1979 | United Kingdom . |

OTHER PUBLICATIONS

Patent Abstract of Japan, vol. 14,No. 174, (M-959)[14117], 5th Apr. 1990; and JP-A-2 28 088 (Yanmar Diesel Ltd.) 30-01-1990; Translations of Japanese Apps. 63-119198 and 2-28088, publication -"The Party Shark" -The Ultimate Jet Ski Accessory.

*Primary Examiner*—Robert Oberleitner
*Assistant Examiner*—C. T. Bartz
*Attorney, Agent, or Firm*—Knobbe, Martens, Olson & Bear LLP

[57] ABSTRACT

A number of embodiments and accessories for a watercraft that is comprised of a main hull that defines a berthing area to receive a small self-propelled watercraft. The main watercraft hull has no propulsion device of its own and is adapted to be propelled by the propulsion device of the smaller watercraft. The controls of the smaller watercraft are accessible from the passenger compartment of the main hull so that the main hull need carry no controls of its own. Various arrangements for accommodating passengers, permitting attachment of an outboard motor to the main hull for its own propulsion and for improving the utility of the main hull are disclosed.

40 Claims, 19 Drawing Sheets

WATERCRAFT

BACKGROUND OF THE INVENTION

This invention relates to a watercraft and more particularly to an improved watercraft of a type that does not have its own propulsion unit and which is formed with a berthing area that is adapted to receive a smaller propelled watercraft and be propelled by that watercraft.

A popular type of marine watercraft is designed primarily to be operated by a single rider with an occasional passenger both of whom are seated in a straddle fashion on the watercraft. This watercraft is normally propelled by a jet propulsion device and has very sporting characteristics. However, there are many instances where it is desirable to accommodate more than an occasional rider with such watercraft. Also, when travelling for long distances, it is desirable if the watercraft can provide a larger storage capacity that is possible with the watercraft per se.

In order to overcome some of these disadvantages, various float like attachment devices have been proposed for attachments to the side of the small watercraft. Although these devices have some utility, they adversely affect the performance of the base watercraft and do not solve all of the problems as aforenoted.

It is, therefore, a principal object of this invention to provide a watercraft of the type which has a hull that defines a berthing area which is designed to accommodate a smaller watercraft and which can be propelled and operated by the controls of that smaller watercraft.

In conjunction with applications wherein the small watercraft is a jet propelled unit, it is desirable that the large ship which has the berthing area is constructed in such a way that the jet propulsion unit of the small watercraft can be operated in its normal fashion and with high efficiency for propelling the larger hull.

It is, therefore, a still further object of this invention to provide a watercraft that is designed to accommodate a smaller watercraft and which has an opening in the berthing area that registers and seals with the opening for the propulsion unit of the smaller watercraft.

In conjunction with the provision of compound watercraft of the type which have been previously described, it is additionally desirable if the larger watercraft is capable of use even when the smaller watercraft is not in position. In some instances, this may make it desirable to provide a separate propulsion device that can propel the larger watercraft even when the smaller watercraft is not in place.

It is, therefore, a still further object of this invention to provide a watercraft that has a berthing area that can receive a smaller watercraft for propulsion by the smaller watercraft and which also accommodates its own propulsion device.

In conjunction with the use of the larger watercraft alone without a berthed smaller watercraft, it is further desirable to provide an arrangement wherein the berthing area can be enclosed.

It is, therefore, a still further object of this invention to provide a watercraft that has a berthing area to accommodate a smaller watercraft and wherein a removable cover arrangement is provided for the berthing area.

It is a further object of this invention to provide such a cover arrangement wherein the covers, when uncovered may serve another function in the larger watercraft.

With watercraft of the type which have been disclosed, it may be possible to drive the smaller watercraft into the berthing area of the larger watercraft under the power of the smaller watercraft. However, when this is done, the smaller watercraft may tend to push the larger watercraft away from it and make docking difficult.

It is, therefore, a still further object of this invention to provide a winching arrangement that permits the smaller watercraft to be winched into the berthing area of the larger watercraft.

SUMMARY OF THE INVENTION

All of the features of this invention are adapted to be embodied in a watercraft that is comprised of a main hull that defines a berthing area that is open through a part of the main hull for receiving a smaller watercraft having a propulsion device and a control unit. A passenger compartment is defined by the main hull and is at least partially juxtaposed to the berthing area.

In accordance with a first feature of the invention, an operator's station is formed within the portion of the passenger compartment in proximity to the controls of the smaller watercraft when berthed for permitting the controls to be operated by an operator within the portion of the main hull passenger compartment.

In accordance with another feature of the invention, the berthing area has an opening extending through the lower surface thereof that is adapted to communicate with the propulsion device of the smaller watercraft for permitting its operation.

In accordance with another feature of the invention, there is provided a cover for the berthing area that is adapted to be moved into a covering area to cover the berthing area when the smaller watercraft is not in the berthing area. In accordance with another feature of this portion of the invention, this cover may be swung into the passenger compartment to provide a table therein when desired.

In accordance with another feature of the invention, the main hull carries a winch that is adapted to be employed for pulling the smaller watercraft into the berthing area.

DETAILED DESCRIPTION OF THE P REFERRED EMBODIMENTS OF THE INVENTION

EMBODIMENTS OF FIGS. 1 THROUGH 15

Figure 1:
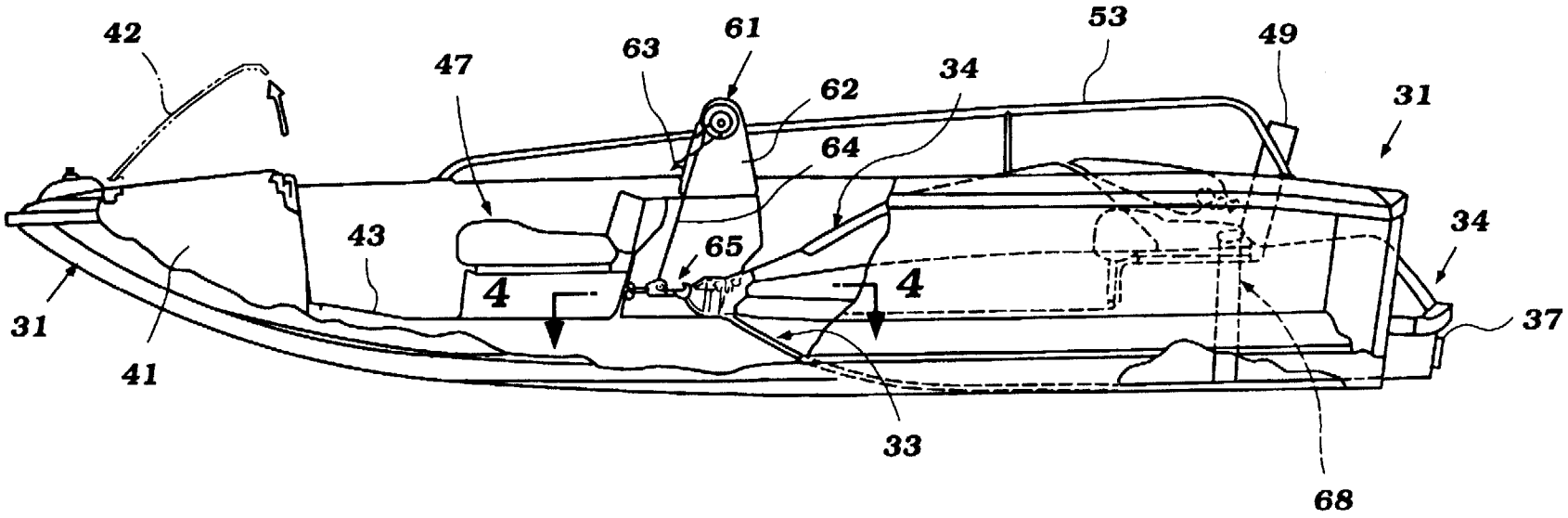
FIG. 1 is a side elevational view, with portions broken away, of a watercraft constructed in accordance with an embodiment of the invention with the smaller watercraft contained within the berthing area.
Figure 2:
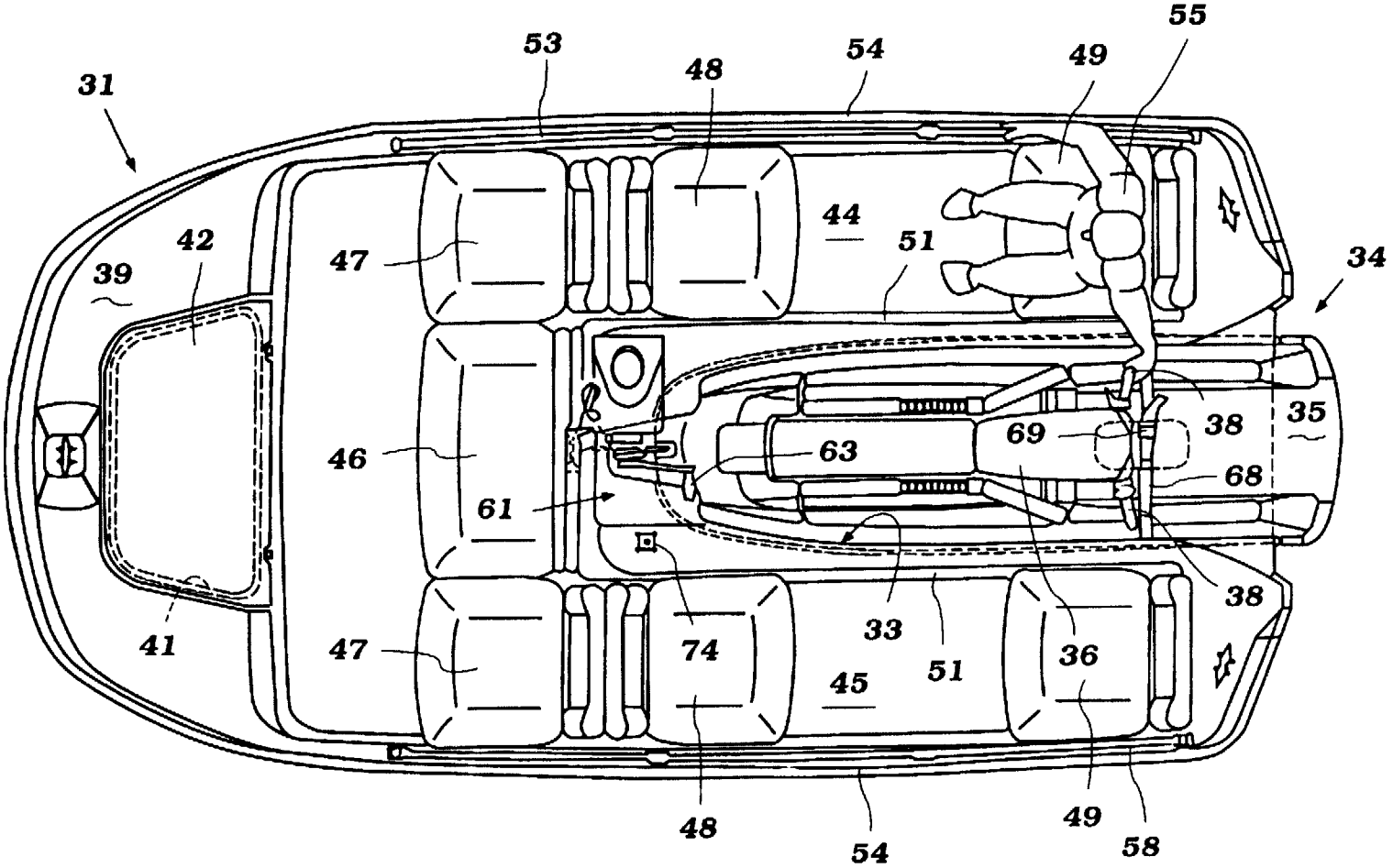
FIG. 2 is a top plan view of the watercraft of this embodiment showing how an operator in the main watercraft may control the propulsion of the main watercraft through controlling the controls of the smaller watercraft.

Referring now in detail this embodiment and initially primarily to FIGS. 1 and 2, a watercraft constructed in accordance with this embodiment of the invention is identified generally by the reference numeral 31. The watercraft 31 is comprised of a main or mother watercraft, indicated generally by the reference numeral 32 which, as will become apparent, is primarily a hull devoid of any propulsion unit and which provides a berthing area, indicated generally by the reference numeral 33 that is adapted to receive a smaller, self propelled watercraft indicated generally by the reference numeral 34.

The smaller watercraft 34 is, in a preferred embodiment of the invention, of the small jet propelled type and which is designed to be operated by a single rider seated in straddle fashion upon a seat thereof or, alternatively, by a single rider that may operate in a kneeling or standing position on a deck 35 formed at the rear of the watercraft. The watercraft 34 has its jet propulsion unit controlled by a tiller assembly, indicated generally by the reference numeral 36 which is employed, in a known manner, to steer the small watercraft 34 by pivoting a pivotally supported steering nozzle 37 in a well known manner. In addition, a twist grip throttle control is mounted on one of a pair of handle bars 38. In the illustrated embodiment, this throttle grip is carried on the right hand side of handle bar 38.

The construction of the small watercraft 34 may take, as has been noted, any known form. However, the invention has particular utility in conjunction with small watercraft that are powered by a jet propulsion unit having a downwardly facing water inlet portion positioned toward the aft part of the midships of the watercraft and which discharges water through the steering nozzle 37.

The hull of the main watercraft 31 may be formed from a suitable material such as molded fiberglass reinforced resin and can be formed in any type of configuration, as will be described. However, it is important that the hull of the watercraft 31 be configured so as to accommodate and provide a relatively large seating area, a condition not present with the small watercraft 34. In this embodiment, the hull of the main watercraft 31 is provided with a forward deck portion 39 that defines a storage compartment 41 which is accessible through a pivotally supported hatch cover 42 which is shown in it open position in phantom lines in FIG. 2. Rearwardly of the deck portion 39, there is provided a passenger compartment which, in this embodiment, is of a generally u-shape having a front portion 43 and a pair of rear side portions 44 and 45. The passenger compartment portions 43, 44 and 45 bound the berthing area 33, as should be readily apparent from FIG. 2.

A generally bench type seating arrangement is provided in the forward seating area 43 and may be formed three aligned seats comprised of a wider central seat 46 and a pair of side seats 47. The side seats 47 may be movably supported so as to afford access to the rear seating areas 44 and 45 in any known manner.

Figure 9:
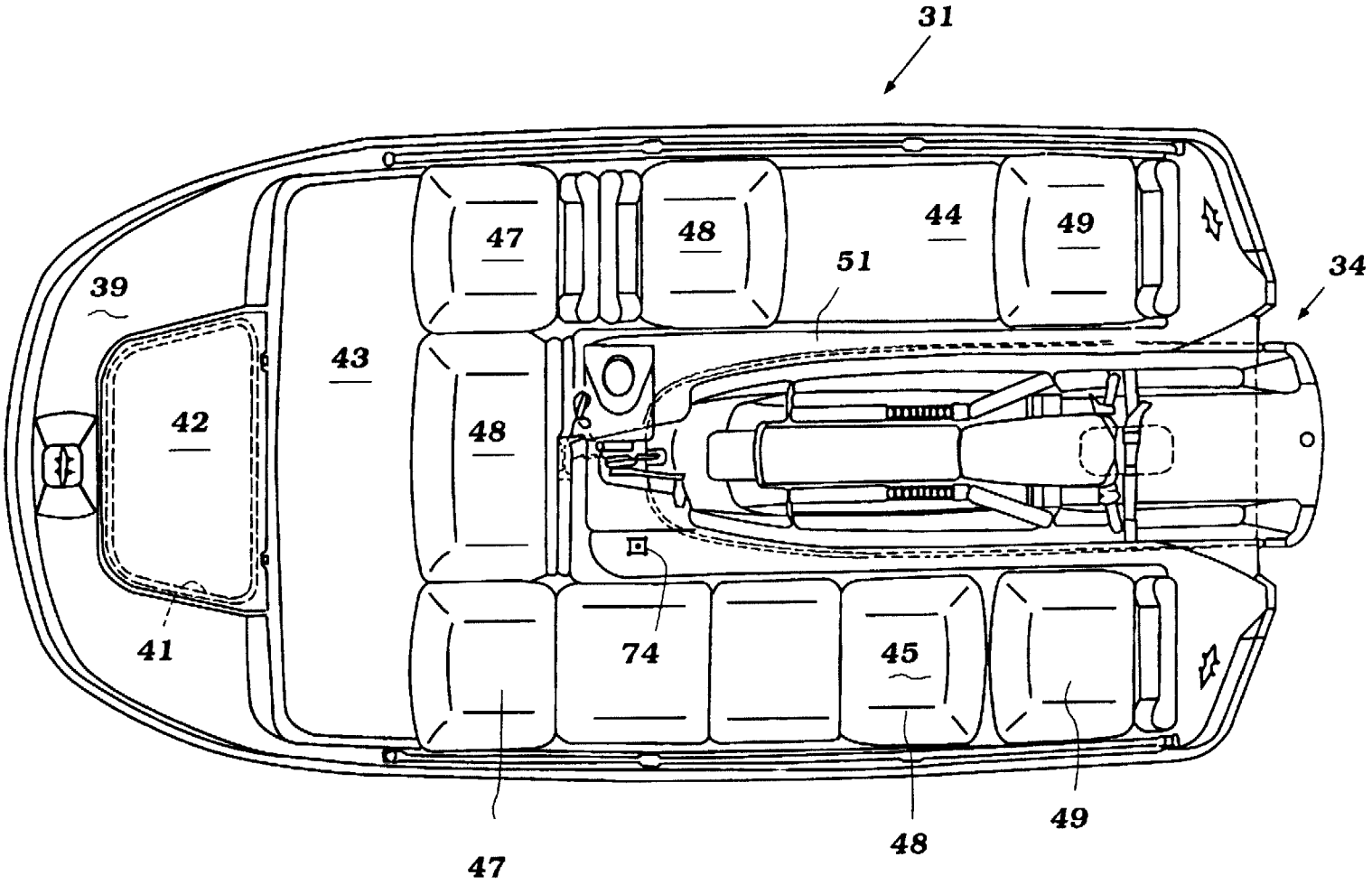
FIG. 9 is a top plan view, in part similar to FIG. 2 and shows the seats in the main watercraft folded down on one side to form a bed.

Each of the rear or side seating areas 44 and 45 is provided with a pair of facing seats 48 and 49 which have folding backrests. These folding backrests may be folded down also to afford access or to provide a sleeping area, as shown on the left hand side of the watercraft in FIG. 9. In the illustrated folding arrangement, the seats 48 and 49 are adapted to be slid on rails toward each other and then their seat backs are folded down to provide a continuous sleeping area. In addition, the seat back of the forward seat 47 may also be folded down as shown in this figure. Of course, a wide variety of other folding arrangements, as are well known in the recreational vehicle field may be employed for this purpose.

Figure 3:
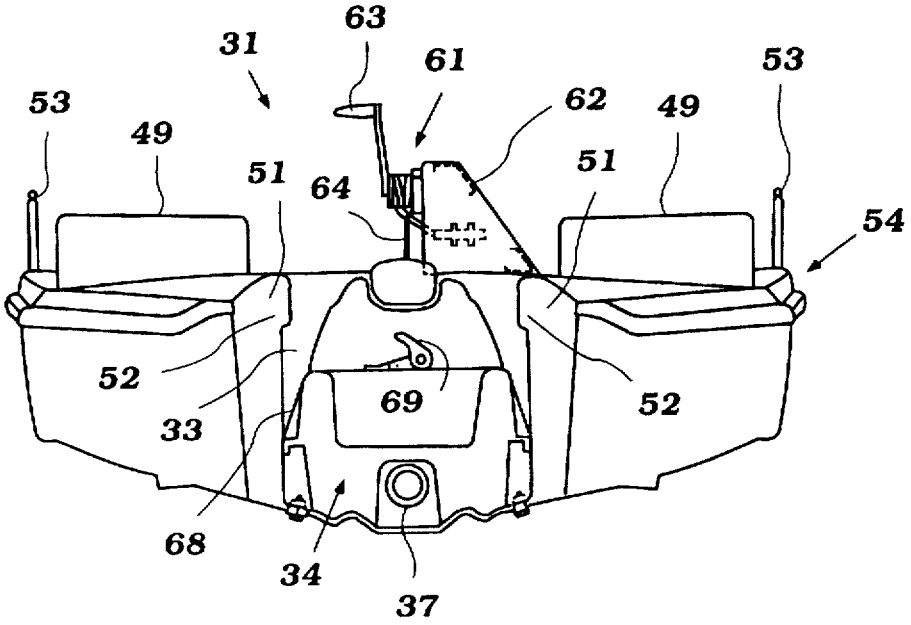
FIG. 3 is a rear elevational view of the watercraft of this embodiment.

Side seating areas 44 and 45 are separated by the berthing area 33 by generally vertically extending walls 51 which define, in part, the outer sides of the berthing area 33. In this embodiment, these walls 51 have slight lips, as best shown in FIG. 3 and identified by the reference numeral 52 which extend over the upper portion of the hull of the small watercraft 34. Also, deck rails 53 extend along the outer side of the hull of the main watercraft on the outer peripheral edges of the rear seating area 44 and 45 and along a portion of the forward seating area 43. These rails 53 are mounted on the outer peripheral sidewalls 54 or gunnels of the hull of the main watercraft 31 in any known manner.

An important feature of the invention is that the berthing area 33 is d isposed relative to at least one of the seatin g areas, in this embodiment the seating area 44 so that an operator, shown at 55, may seat himself in the seat 49 and reach the controls for the watercraft in 34 including the twist grip throttle control on the handlebar 38 and the handlebar 38 for controlling both the speed and direction of travel of the main watercraft 31 which will be propelled by the propulsion unit of the smrall waterraft 34. As a result of this, it is possible to use the small watercraft 34 as, in effect, a pushing power unit for the main watercraft 31. In addition the lower hull configuration, as will be described, the hull of the main watercraft 31 is complimentary to that of the small watercraft 34 so that very little water resistance will be encountered and the small watercraft 34 will offer adequate power to propel the entire watercraft assembly. Also by providing the seating area so that the operator 55 may operate the controls of the small watercraft 34 it is unnecessary to provide any remote control or control linkage between the small watercraft and the main watercraft 31. This provides an obvious advantage and also permits relatively lower cost.

The construction of the berthing area 33 and the manner in which it accommodates the small watercraft 34 will now be described by primary reference to FIGS. 3 through 8. In this embodiment of the invention and in order to provide efficient of the jet propulsion unit of the small watercraft 34 and provide a good and smooth hull line, the lower portion of the berthing area 33 is provided with a generally integral wall 56 which forms an extension of the underside of the hull of the main watercraft 31 and which is bounded by the upstanding side walls 51 which define, as has been noted, the boundary between the seating areas 44 and 45 and the berthing area 33. At its forward portion, as shown best in FIGS. 4 through 6, this lower wall 56 curves upwardly and defines a recess 57 with a bulks head assembly 58 which is formed appropriately in the body of the hull of the main watercraft 31 and which extends transversely across the front of the berthing area 33. A cushion member 59 is positioned within this recess 57 and is adapted to provide a resilient support for the front end of the small watercraft 34 when in position.

Figure 4:
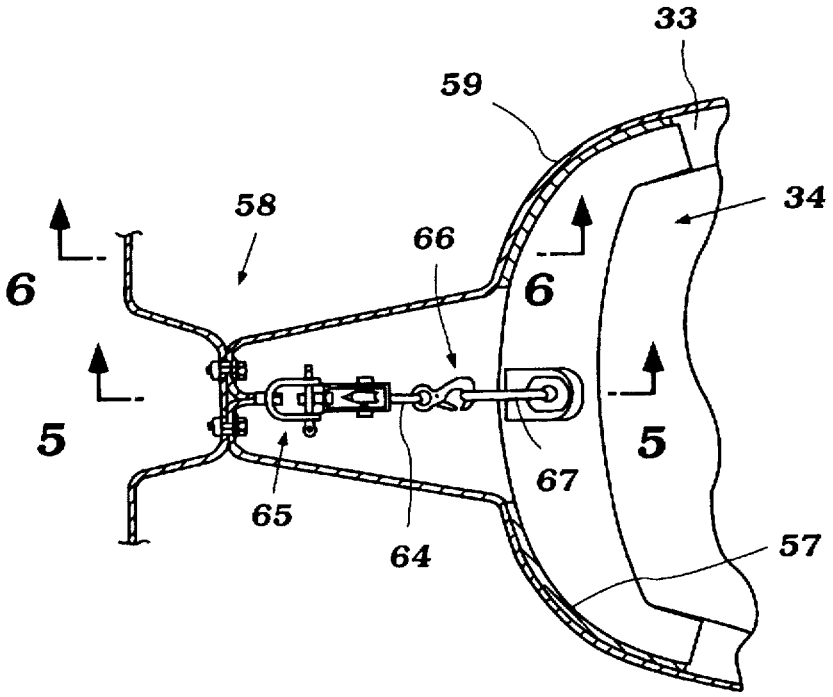
FIG. 4 is an enlarged cross-sectional view taken along the line 4—4 of FIG. 1 showing how the small watercraft is maintained in position.
Figure 5:
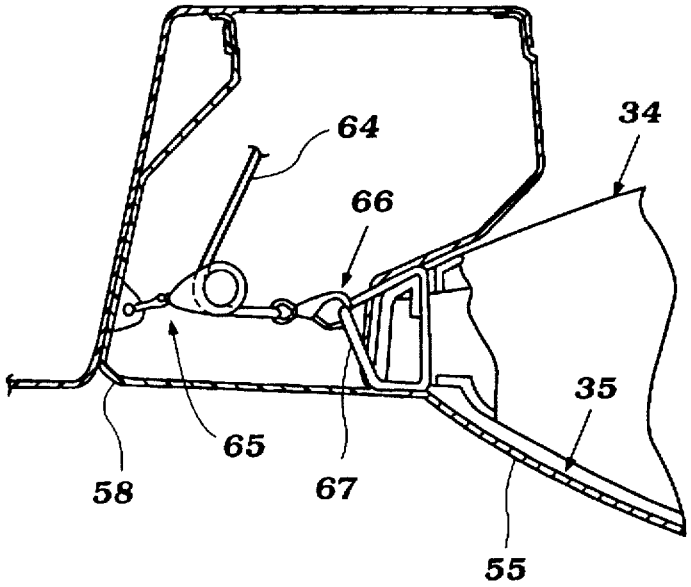
FIG. 5 is a cross-sectional view taken along the line 5—5 of FIG. 4.
Figure 6:
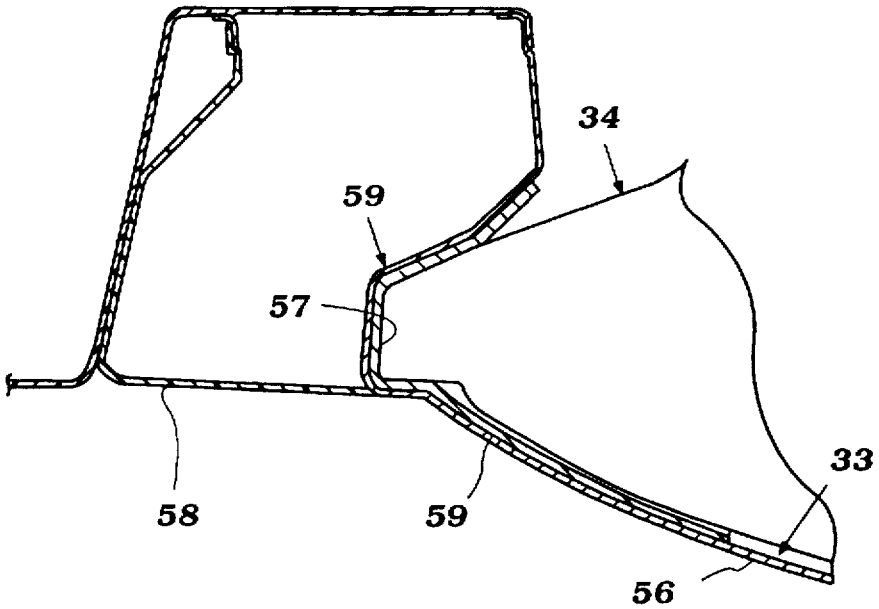
FIG. 6 is a cross-sectional view taken along the line 6—6 of FIG. 4.

The small watercraft 34 may be drawn into the berthing area 33, in a manner which will be described, by means of a manual or electrically operated winch assembly 61. The winch assembly 61 is mounted by means of mounting brackets 62 on the bulkhead assembly 58. If manually operated, the winch assembly 61 has a crank or handle 63 for winding a cable 64 on the drum of the winch 61 in a well known manner. Referring to FIGS. 4 and 5, the cable 61 extends downwardly and then is wound around a pulley 65 carried at the front of the bulkhead 58 and internally thereof so as to extend rearwardly toward the berthing area 33. A releasable hook type fastener 66 is carried at the end of the cable assembly 64 and is adapted to be detachably connected to a bracket 67 affixed to the front of the small watercraft 34 for drawing the small watercraft into position within the berthing area 33. One manner in which this may be done will be described later by reference to FIGS. 27 through 29.

A strap 68 is provided at the rear of the berthing area and is adapted to extend over the rear of the small watercraft 34 in proximity to the water inlet opening area of its jet propulsion unit for holding the rear portion of the small watercraft 34 in the berthing area. A buckle 69 is provided so as to permit tightening and loosening of the strap 68 in a well known manner.

Figure 7:
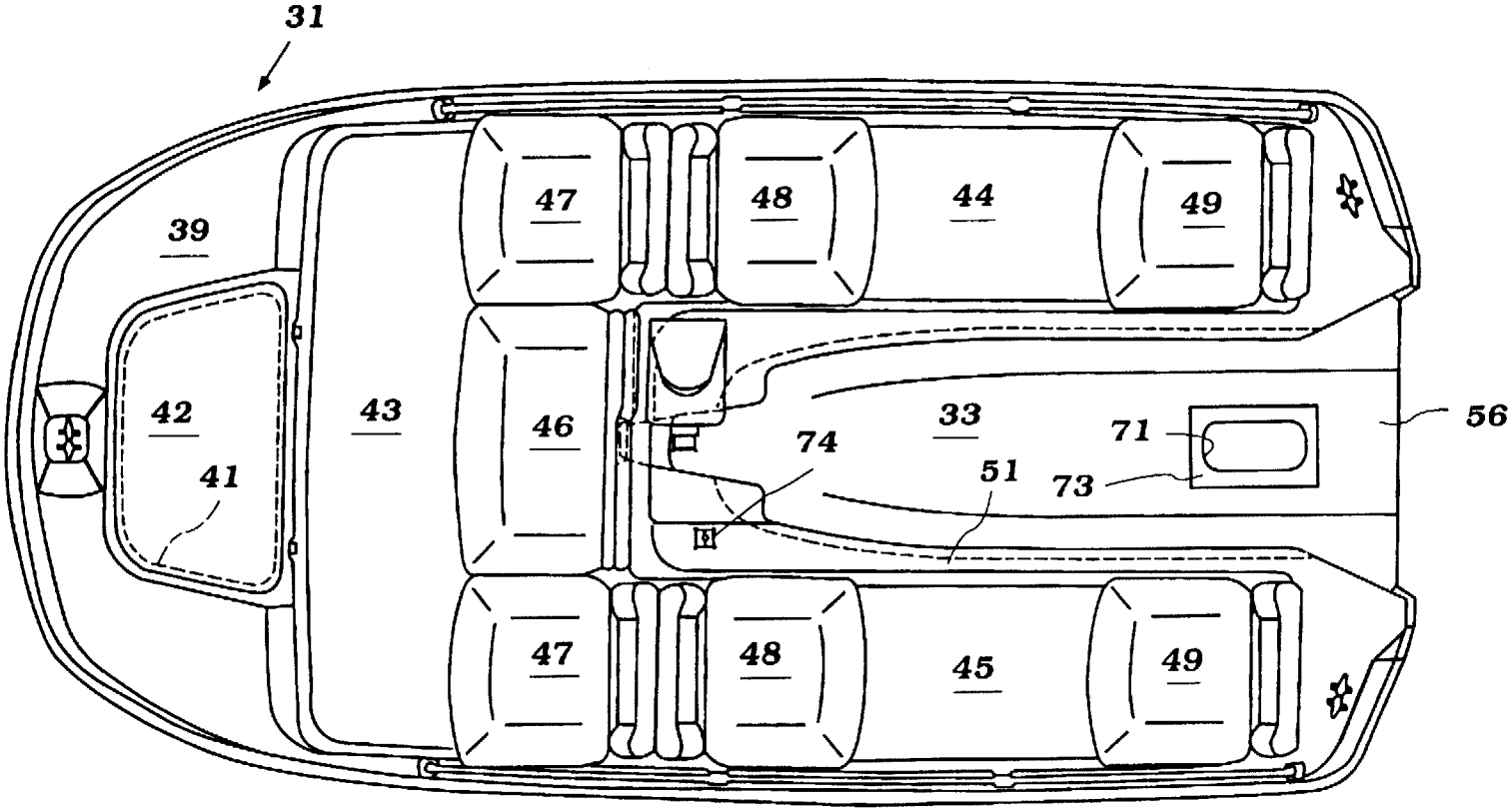
FIG. 7 is top plan view, in part similar to FIG. 2, and shows the main watercraft with the small watercraft not in position.
Figure 8:
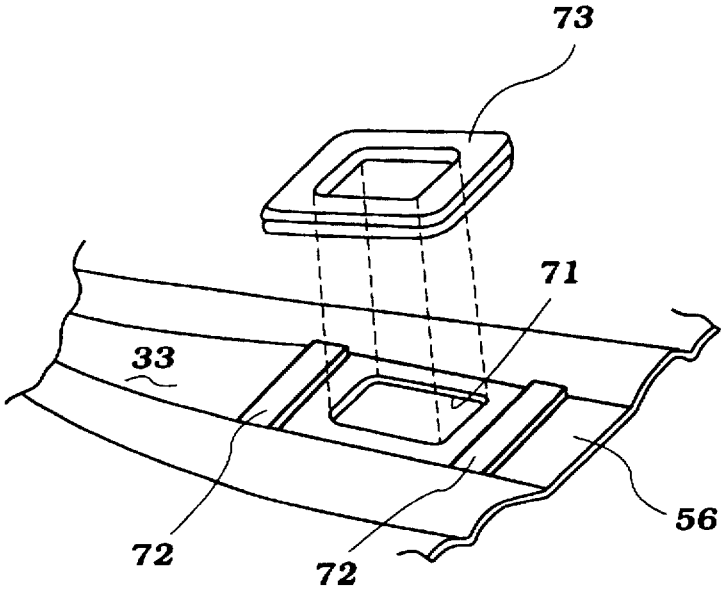
FIG. 8 is a partially exploded perspective view showing the sealing arrangement for sealing between the water inlet of the berthing area of the main watercraft and that of the small watercraft.

Referring now in detail primarily to FIG. 7 and 8, the construction of the hull of the main watercraft 31 that cooperates with the water inlet of the jet propulsion unit of the small watercraft 34 will be described. It should be noted that the lower hull portion 56 of the main watercraft 31 is provided with an enlarged rectangular opening 71 that is defined between a pair of spaced cross braces 72 which give rigidity to the hull portion 56. An elastic type seal 73 is pressed into the opening formed between the reinforcing members 72 and the sides of the lower portion 56 and may be affixed in place by a suitable adhesive. The seal 73 has sufficient resilience so as to form a tight watertight seal around the water inlet opening of the small watercraft 34 when it is in place in the berthing area 33 and held rigidly thereby the cooperation of the configuration of the recess 57 at the front of the bulkhead 58 and the strap 68. As a result, the jet propulsion unit of the small watercraft 34 will operate with maximum efficiency even when in the berthing area 33 of the larger watercraft 31 and hence the power of the small watercraft 34 will be adequate to propel the larger watercraft 31 through the water at a desired speed.

Figure 10:
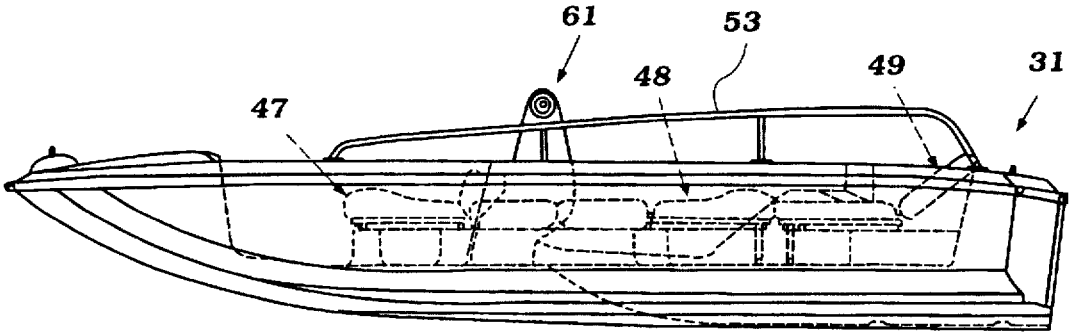
FIG. 10 is a side elevational view of the construction shown in FIG. 9 and illustrates how the seats are folded down.
Figure 11:
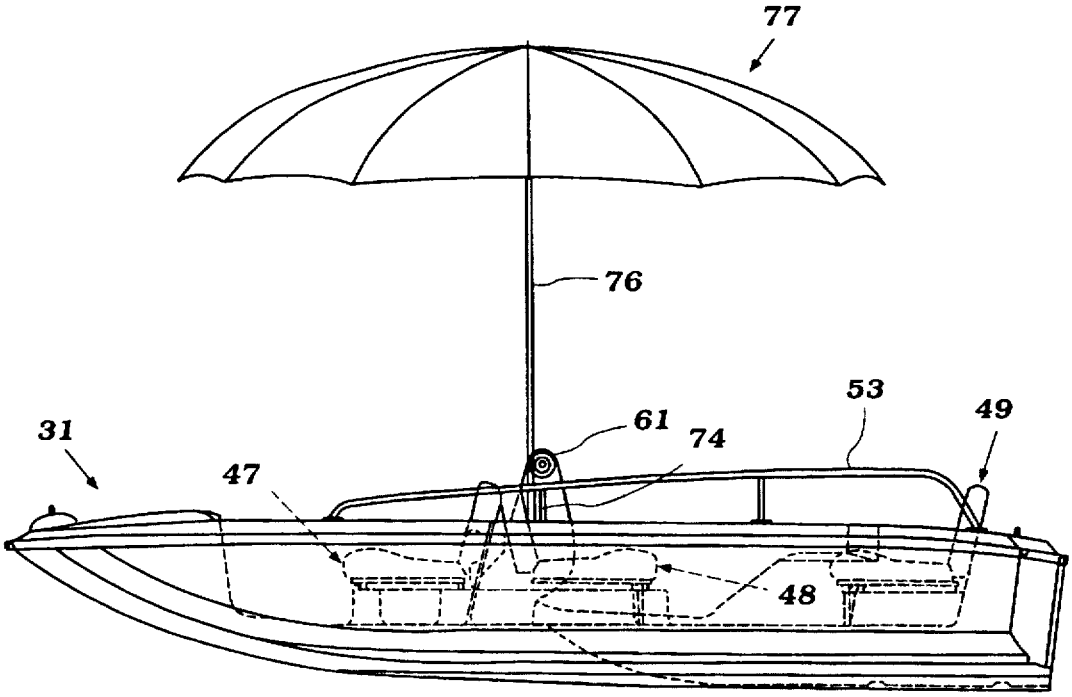
FIG. 11 is a side elevational view, in part similar to FIG. 1 and shows the watercraft with a protective umbrella erected.
Figure 12:
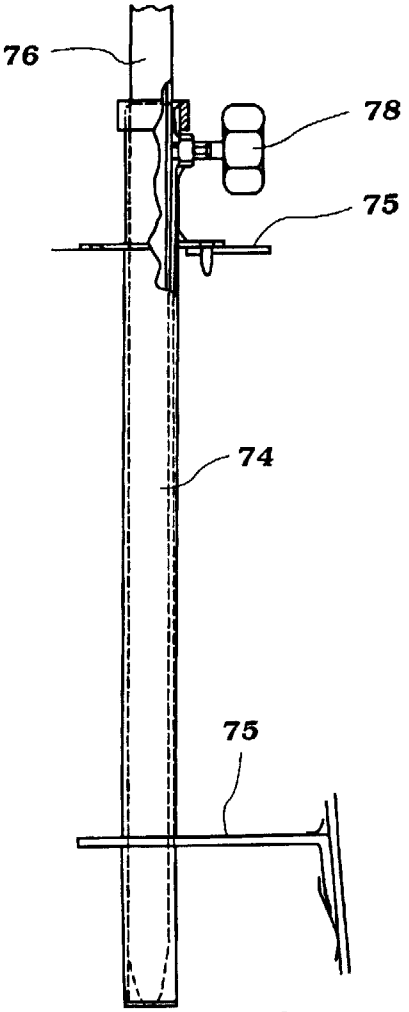
FIG. 12 is a cross-sectional view showing how the umbrella is supported within the hull of the main watercraft.
Figure 14:
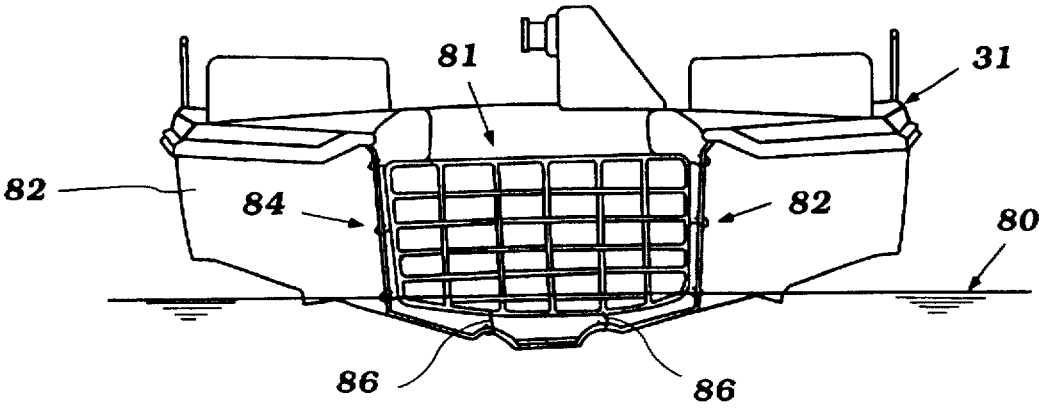
FIG. 14 is a rear elevational view of the main watercraft with a safety net in position and without the small watercraft being contained within the berthing area.
Figure 15:
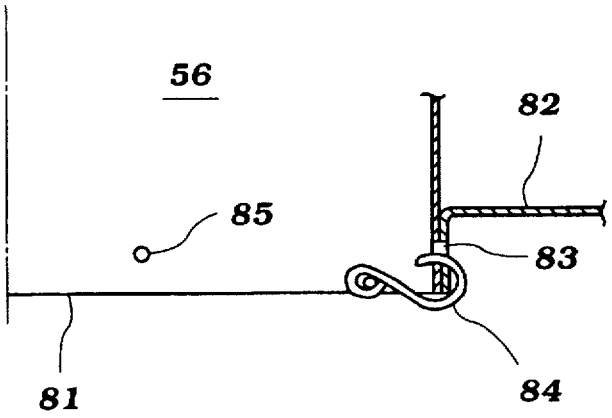
FIG. 15 is an enlarged cross-sectional view taken along a plane perpendicular to the plane of FIG. 14 and through one of the net attachments to the hull.

In order to permit maximum utilization of the main watercraft 31 either with or without the small watercraft 34 in place a wide variety of accessory devices may be incorporated. For example, and as best shown in FIGS. 10 through 12, the passenger compartment of the main watercraft 31 may be provided with a mast support 74 that is positioned to the forward left side of the berthing area 33 on the bulkhead 51 at this side. As may be best seen in FIG. 12, this mast support 74 is comprised of a tubular member that is affixed to a pair of brackets 75 which are affixed in any suitable manner to the hull of the main watercraft 34. This tubular member is adapted to receive the post 76 of a large beach umbrella, indicated generally by the reference numeral 77 which can be erected, as shown in FIGS. 11 and 12, to provide shade over a large portion of the seating area. A thumb screw type fastener 78 is provided for holding and locking the mast 76 in place.

Figure 13:
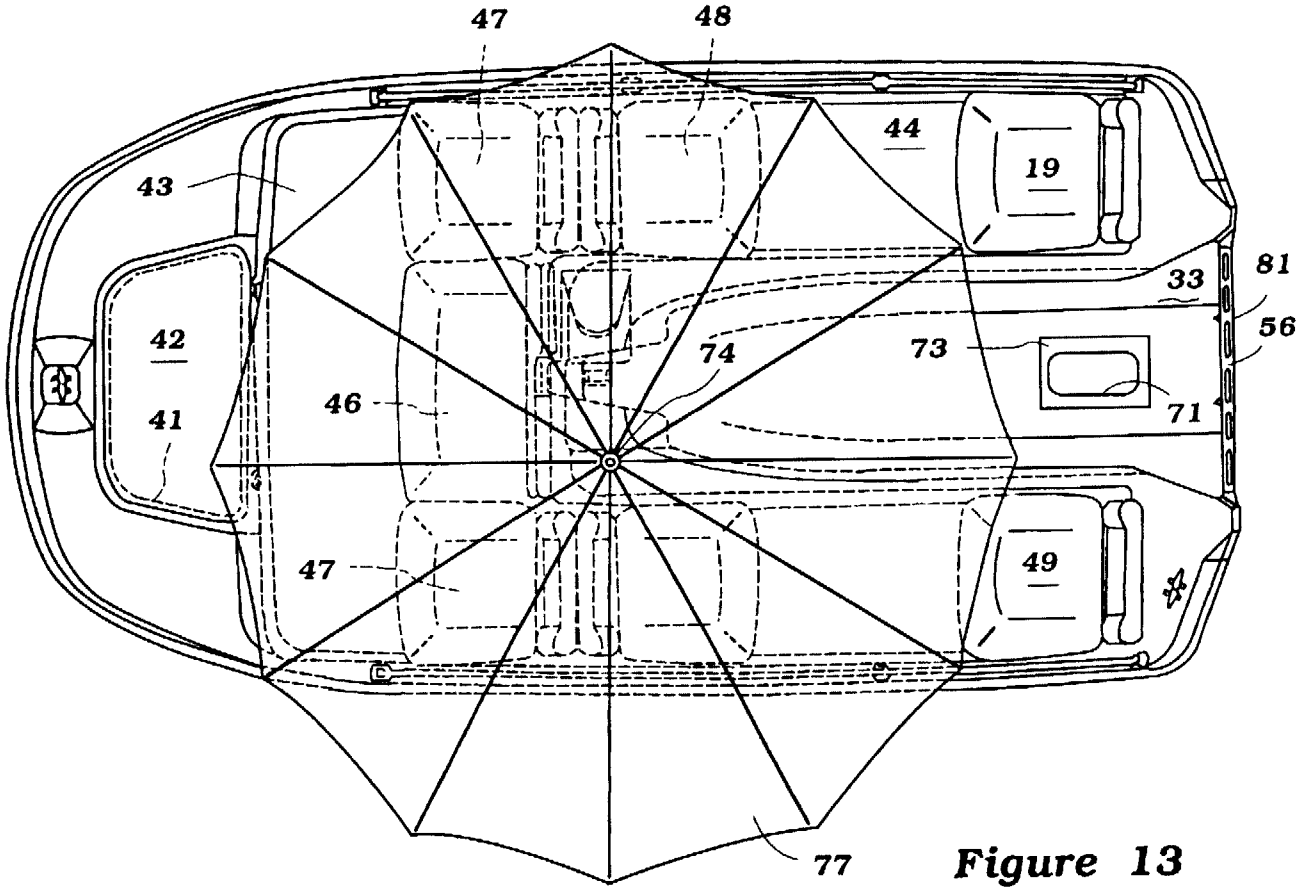
FIG. 13 is a top plan view of the construction showing the configuration in the condition of FIG. 11.

As may be seen in FIG. 13, when the small watercraft is not in position, the berthing area 33 provides a large open area which can be employed as a children 's play area. In fact, water may be permitted to enter into this area and it can easily serve as a small floating swimming pool for children 's play. In order to provide safety, a safety net 81 can be detachably affixed across this berthing area to provide assurance that the children will not become displaced from the watercraft. The main watercraft 31 has in its transom area 82 a plurality of spaced openings 83 that are adapted to receive hooks 84 carried by the ends of the net 81 so as to lock the net 81 in place. In addition, the lower hull portion 56 is also provided with apertures 85 to receive complimentary hooks 86 so as to further assure safety.

EMBODIMENT OF FIGS. 16 THROUGH 18

Figure 16:
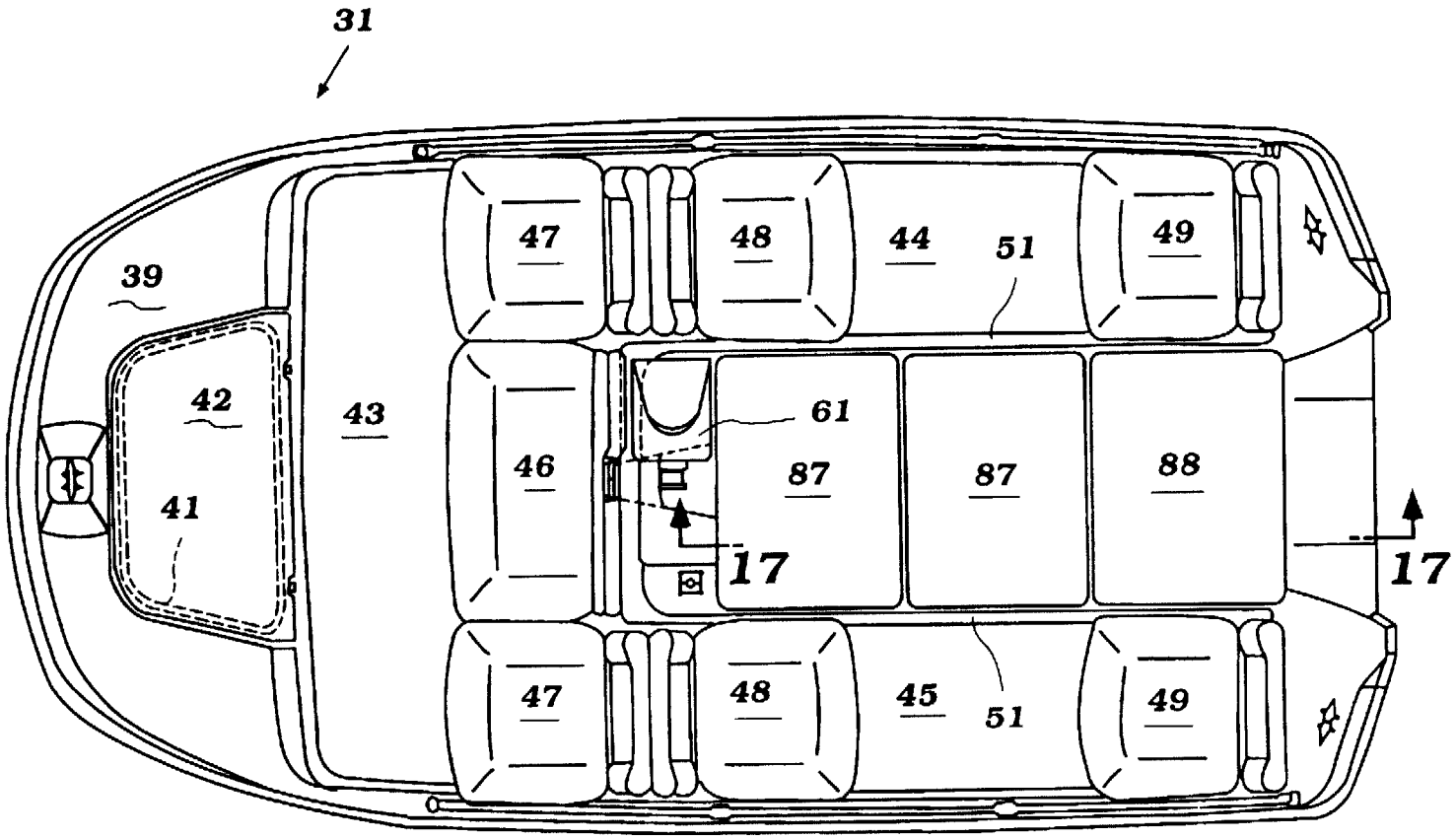
FIG. 16 is a top plan view, in part similar to FIG. 7 and shows another embodiment of the invention having a cover arrangement for the berthing area.
Figure 17:
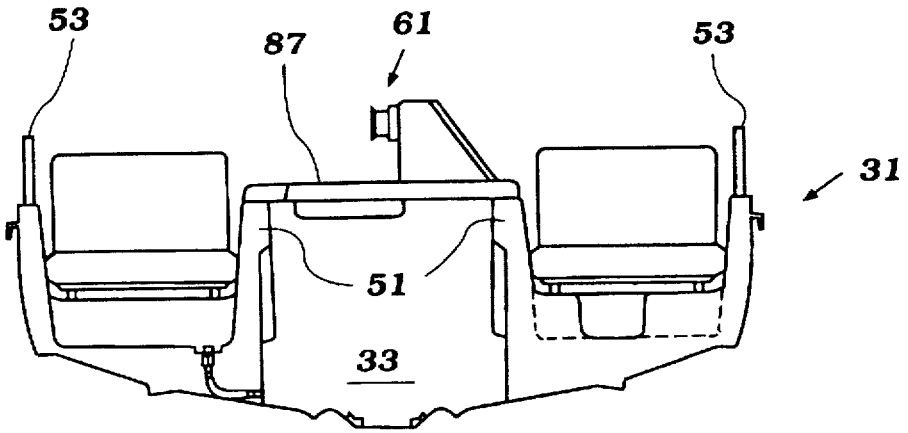
FIG. 17 is a cross-sectional view taken along the line 1717 of FIG. 16.
Figure 18:
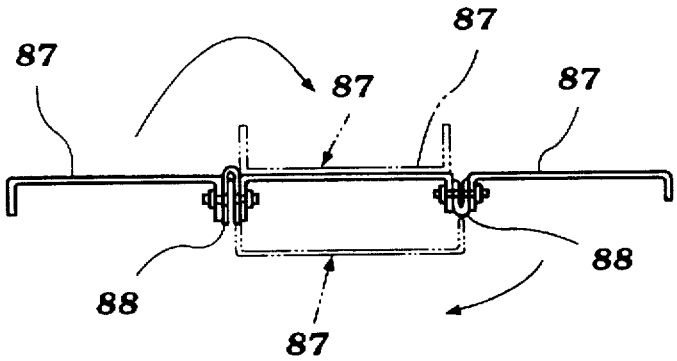
FIG. 18 is a partial view, in part similar to FIG. 17 and shows how the covers for the berthing area can be moved between their closed covering position and an open, table forming position.
Figure 19:
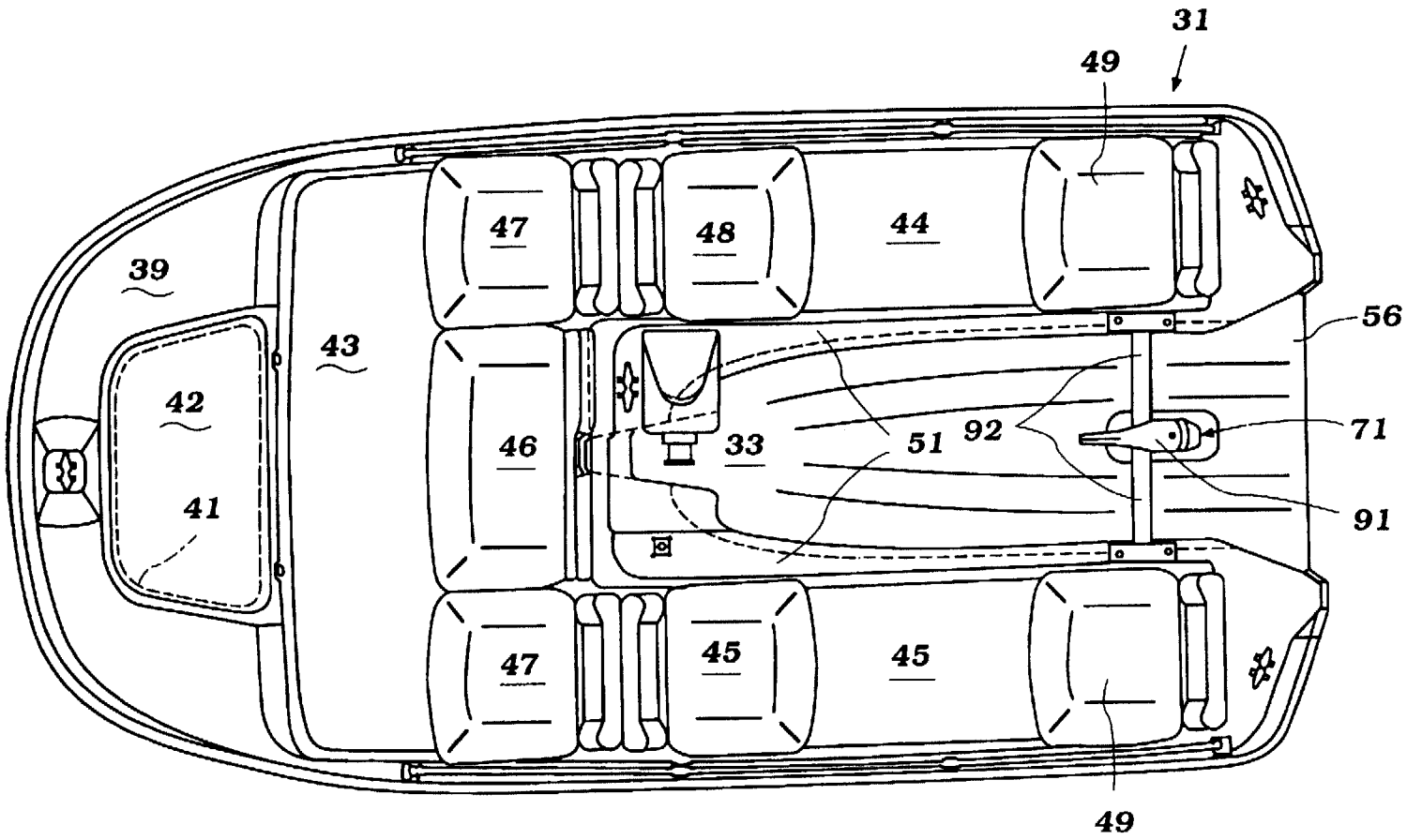
FIG. 19 is a top plan view, in part similar to FIG. 7 and shows how an outboard motor may be employed in conjunction with the main hull for its propulsion.
Figure 20:
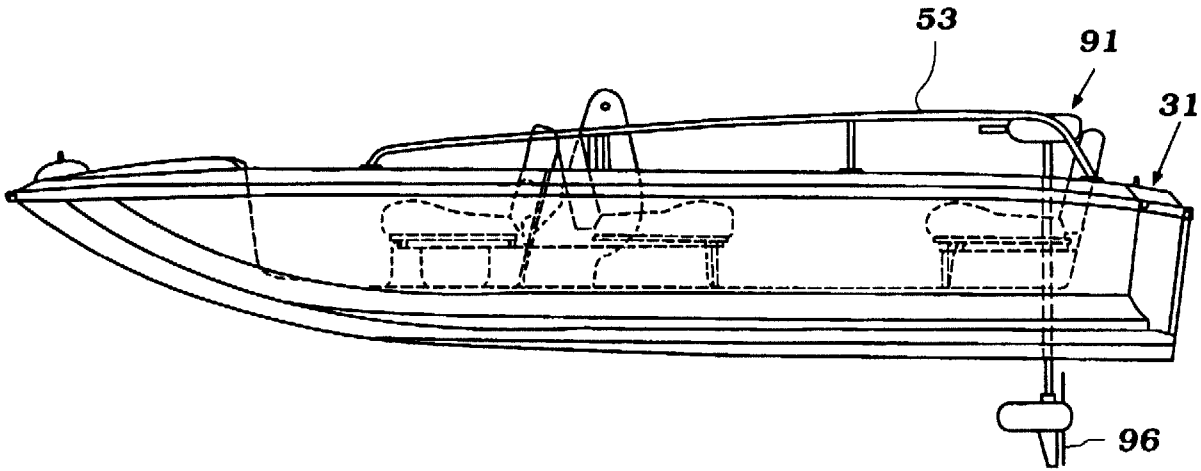
FIG. 20 is a side elevational view of the construction shown in FIG. 19.
Figure 21:
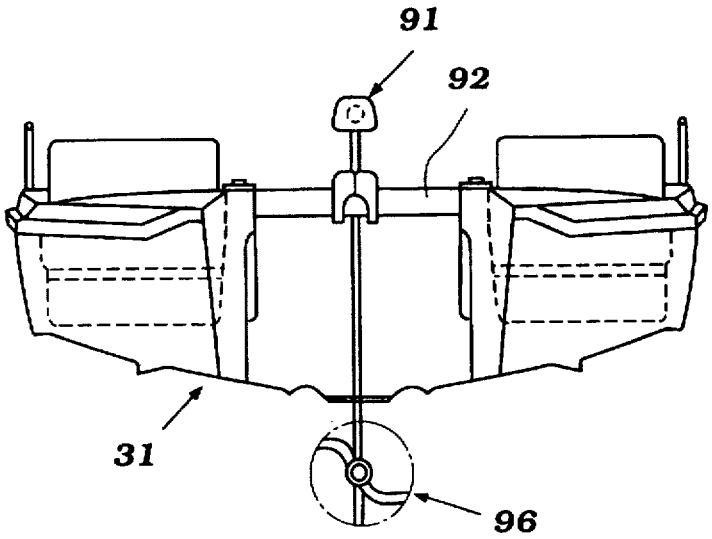
FIG. 21 is a rear elevational view thereof.
Figure 22:
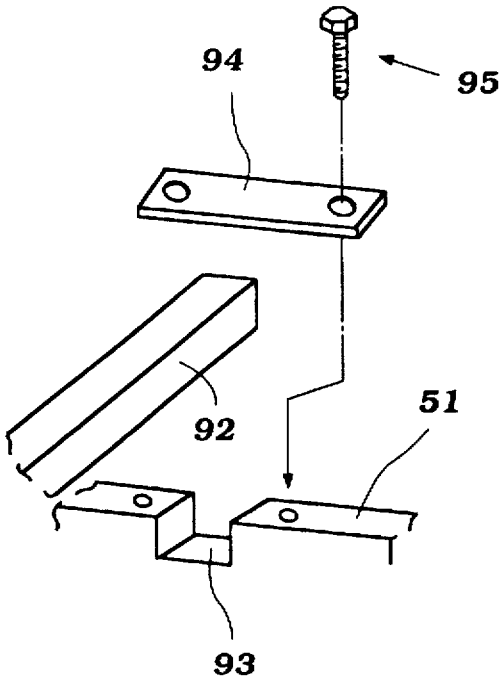
FIG. 22 is a partially exploded perspective view showing the manner of attachment of the outboard motor to the hull of the main watercraft.

FIGS. 16 through 18 show another embodiment of the invention wherein an accessory cover may be provided for covering the berthing area 33. In accordance with this embodiment of the invention, there are provided a plurality of individual lid covers 87 that have adjacent edges connected to each other by flexible strap hinges 88 so that the covers may be folded from an extended covering position over the berthing area 33 as shown in FIGS. 16 and 17 and in the solid line view of FIG. 18 to a storage area where they are stacked upon the other as shown in phantom line views in FIG. 18. Alternatively, the covers 87 may be folded to provide a table area which can be erected between any of the facing seats 48 and 49 within the passenger compartment portions 44 or 45. The mechanism also would permit the folded cover assembly to be placed on shore and erected as a table there.

EMBODIMENTS OF FIGS. 19 THROUGH 22

In the embodiments as thus far described, the main watercraft 31 has not been provided with any propulsion device of its own and it has been necessary to propel it by means of the small watercraft 34 contained within the berthing area. FIGS. 19 through 22 show how the main watercraft 31 may be propelled easily by any type of conventional outboard motor. Such an outboard motor is indicated by the reference numeral 91 and may comprise any known type of outboard motor, either gasoline or battery powered. A bridging piece 92 spans the side walls 51 and is received in notches 93 (FIG. 22) formed therein. The bridging member 92 is held in place by brackets or retainer straps 94 that are held to the walls 51 by threaded fasteners 95. The outboard motor 91 is conveniently affixed to the mounting member 92 and has its propeller 96 depending through the opening 71 in the lower wall 56 of the berthing area so as to depend into the body of water in which the watercraft is operating. The watercraft can then be propelled by the outboard motor 91 which is easily accessible from either of the seats 49 due to their positioning in proximity to the area where the controls of the small watercraft are located when it is put into position.

EMBODIMENT OF FIGS. 23 AND 24

Figure 24:
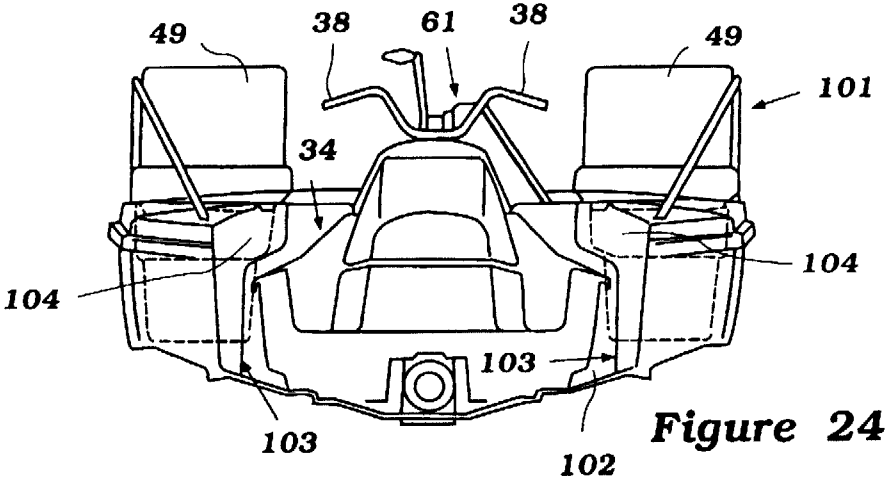
FIG. 24 is a rear elevational view of this embodiment.
Figure 23:
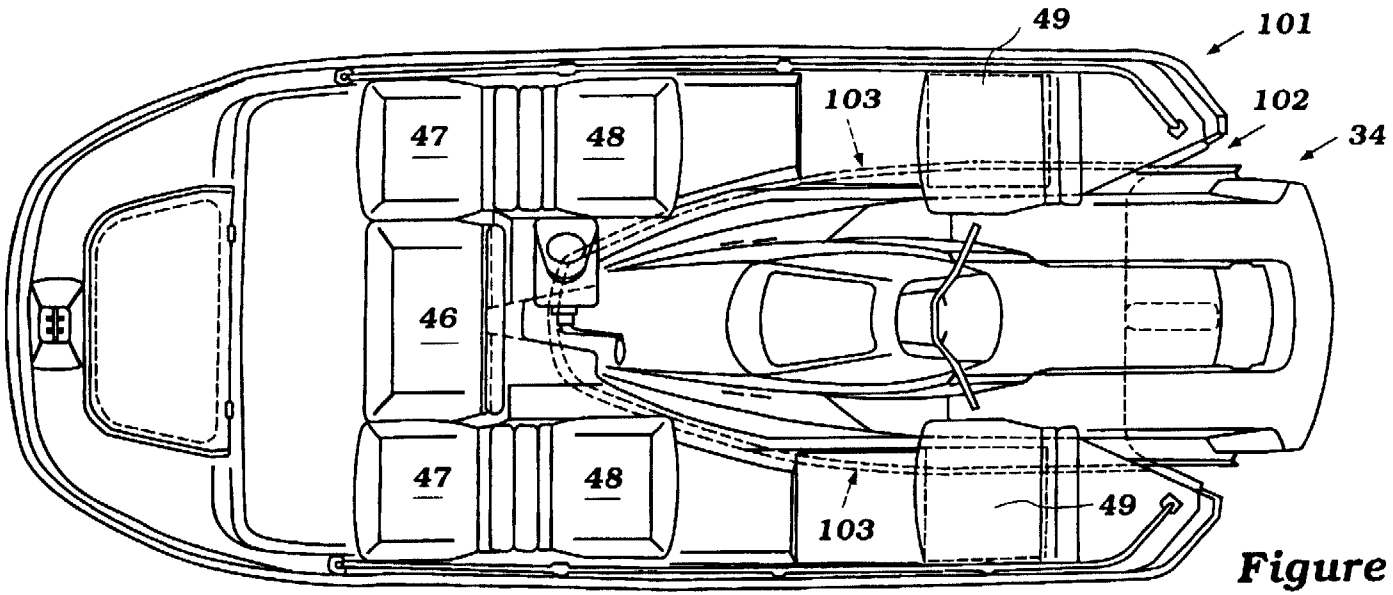
FIG. 23 is a top plan view, in part similar to FIG. 2, and shows a further embodiment of the invention.

In the embodiments as thus far described the main watercraft 31 has a relatively wide berthing area 33 so as to accommodate the small watercraft. This wide berthing area has been provided since the sidewalls 51 are spaced substantially outwardly from the berthing area 33 and the sides of the small watercraft. A narrower hull can be employed and FIGS. 23 and 24 show how this can be done wherein the main watercraft is identified generally by the reference numeral 101. The general layout of the main watercraft 101 is the same as that previously described except for the differences which will be subsequently noted. For that reason, components which are the same or substantially as the previously described embodiments have been identified by the same reference numerals and will be described in so far as is necessary to understand the construction and operation of this embodiment. In this embodiment a berthing area 102 is defined by sidewalls 103 which are generally wide apart at their lower end but which have inwardly extending portions 104 that substantially overlie the side portions of the small watercraft 34 and thus permit the seating and passenger areas to be positioned there above. In all other regards, this embodiment is the same as those previously described, as aforenoted.

EMBODIMENT OF FIGS. 25 AND 26

Figure 26:
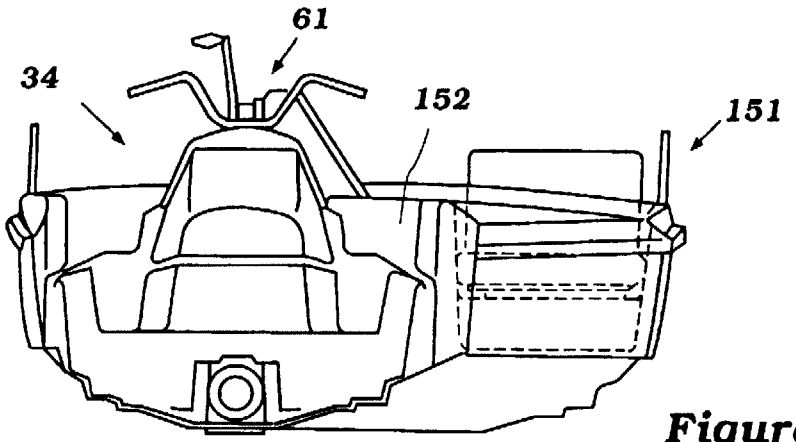
FIG. 26 is a rear elevational view of this embodiment.
Figure 25:
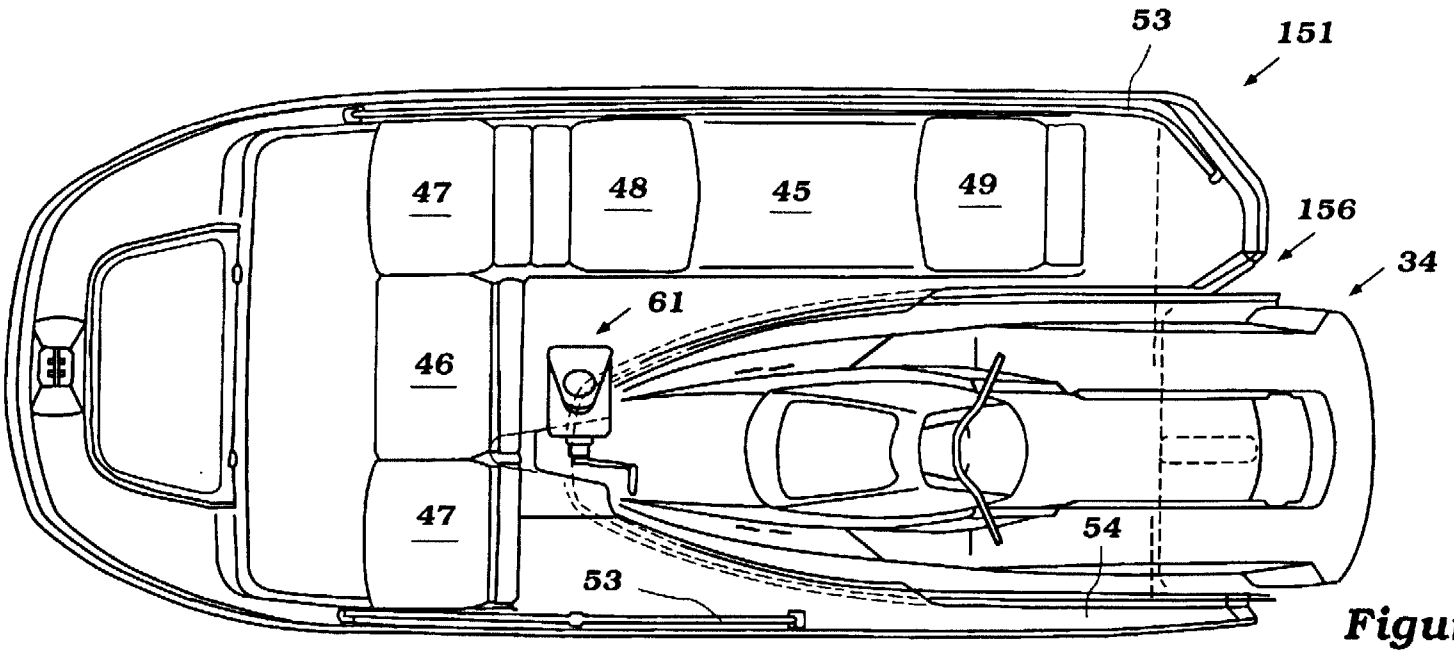
FIG. 25 is a top plan view, in part similar to FIGS. 2, 9 and 23 and shows a still further embodiment of the invention.

In each embodiment as thus far described, the berthing area 33 has been positioned substantially along the longitudinal center line of the watercraft. FIGS. 25 and 26 show another embodiment which is generally the same as the embodiments previously described but permits a narrower shape for the main watercraft, indicated generally by the reference numeral 151 in these figures. In this embodiment, the berthing area 152 is disposed at one longitudinal side of the watercraft and encroaches on the area and eliminates the seating area 45 of the previously described embodiments. Again, however, the rear seat 49 within the seating area 44 is positioned so that an operator seated therein may operate the controls of the small watercraft 34.

EMBODIMENT OF FIGS. 27 THROUGH 29

Figure 27:
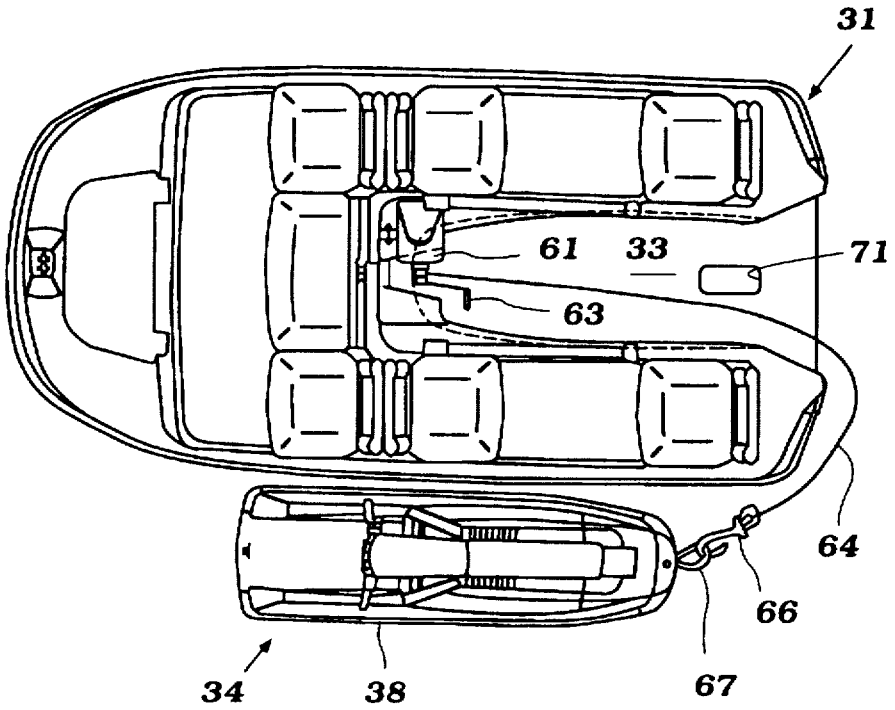
FIG. 27 is a top plan view, which may be considered typical of all embodiments, and shows how the small watercraft may be winched into the berthing area of the main watercraft.
Figure 28:
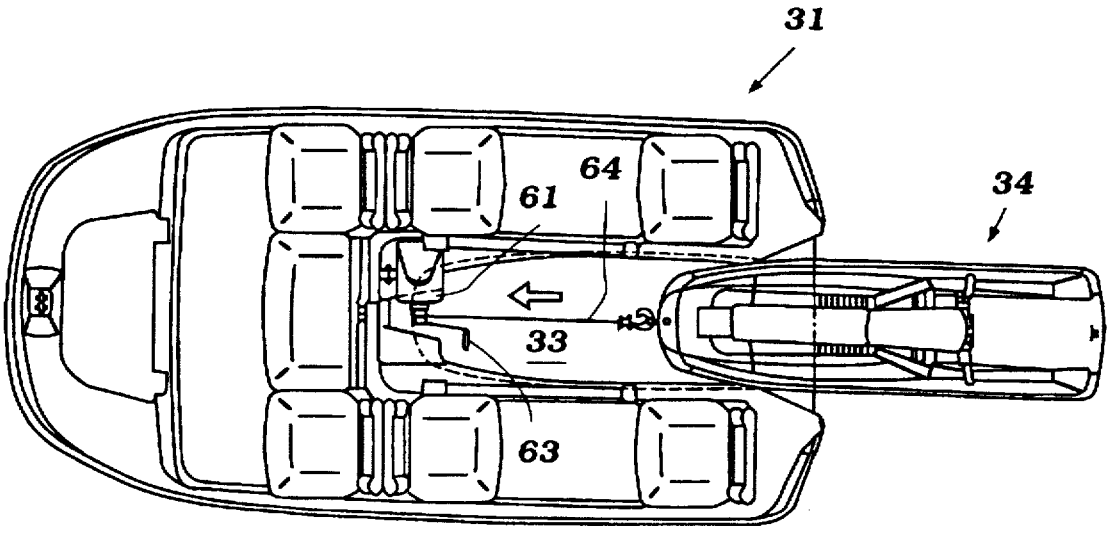
FIG. 28 is a top plan view, in part similar to FIG. 27, and shows an intermediate position in the berthing operation.
Figure 29:
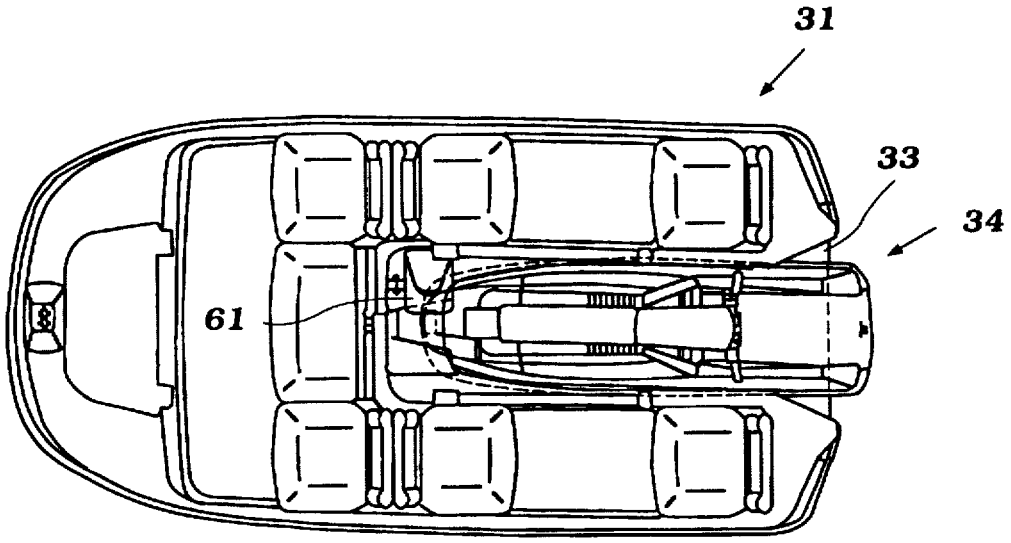
FIG. 29 is top plan view, in part similar to FIGS. 27 and 28, and shows the completion of the berthing operation.

FIGS. 27 through 29 show the way in which the small watercraft 34 may be winched into the berthing area 33 of the main watercraft 31. The main watercraft 31 in these figures is a main watercraft of the type in shown in FIGS. 1 through 24, however, it should be readily apparent to those skilled in the art that the same berthing procedure may be employed in conjunction with the embodiment of FIGS. 25 and 26.

As shown in FIG. 27, small watercraft 34 is brought along side of one of the sides of the main watercraft 31 and the winch 61 is operated so as to play out the cable 64 adequately to permit its hook 66 to be connected to the fastener 67 on the front of the small watercraft 34. The winch 61 is then operated to draw in the cable 64 which will cause the small watercraft to move along the side of the main watercraft 31. Due to the tapered transom of the main watercraft 31 the small watercraft 34 will be turned as shown in FIG. 28 to enter the berthing area 33. Continued pulling in of the cable 64 will then cause the small watercraft 34 to be drawn into the berthing area 33 where it may be retained in place in the manner previously described.

It should be readily apparent from the foregoing description that the described construction provides a very useful way in which a small watercraft can be converted into a larger watercraft and the larger watercraft may be utilized for carrying more passengers than the smaller watercraft accommodates. This can be done without reducing the performance to any significant effect and also which does not require a separate propulsion device for the larger watercraft. The controls of the small watercraft are easily accessible from the larger watercraft and hence the combined watercraft can be easily propelled. In addition, the main watercraft can be used independently of the smaller watercraft as a floating base or a raft. In addition, the larger watercraft can be independently propelled through an auxiliary outboard motor if desired. Of course, the foregoing description is that of preferred embodiments of the invention and various changes and modifications may be made without departing from the spirit and scope of the invention, as defined by the pended claims.

We claim:

1. A watercraft comprised of a main hull defining a berthing area opening through a part of said main hull for receiving a smaller watercraft having a propulsion device and controls therefore, a passenger compartment defined by said main hull and at least partially juxtaposed to said berthing area, and an operator station positioned in said portion of said passenger compartment and juxtaposed to the controls of said smaller watercraft for permitting said controls to be operated by an operator within said portion of said main hull passenger compartment, a plurality of seats in said passenger compartment and a removable cover for at least partially covering said berthing area said removable cover being folded into a table for use by persons seated on said seats in the passenger compartment.

2. A watercraft as set forth in claim 1 wherein the removable cover is folded into a table for use in the passenger compartment.

3. A watercraft comprised of a main hull as set forth in claim 1 wherein at least two of the seats are oppositely facing and the table can be positioned there between.

4. A watercraft comprised of a main hull defining a berthing area opening through a part of said main hull for receiving a smaller watercraft having a propulsion device and controls therefore, a passenger compartment defined by said main hull and at least partially juxtaposed to said berthing area, and an operator station positioned in said portion of said passenger compartment and juxtaposed to the controls of said smaller watercraft for permitting said controls to be operated by an operator within said portion of said main hull passenger compartment, said jet propulsion unit of the smaller watercraft having a water inlet portion formed in the hull thereof in a downwardly facing direction, and said main hull having an opening in the lower surface of its berthing area aligned with said water inlet opening of said smaller watercraft when said smaller watercraft is in the berthing area.

5. A watercraft comprised of a main hull as set forth in claim 4 further including seal means carried around the opening of the main hull for sealing with the water inlet opening of the small watercraft jet propulsion unit.

6. A watercraft comprised of a main hull as set forth in claim 5 wherein the small watercraft has a rearwardly opening discharge nozzle with a steering nozzle carried thereby.

7. A watercraft comprised of a main hull as set forth in claim 6 wherein the small watercraft control accessible from the main watercraft passenger compartment comprises a steering control for the steering nozzle of the small watercraft.

8. A watercraft comprised of a main hull as set forth in claim 7 further including a throttle control for a powering internal combustion engine of the small watercraft accessible by the operator in the operator 's area of the main hull passenger compartment.

9. A watercraft comprised of a main hull as set forth in claim 8 wherein there is a seat provided in the main hull passenger compartment where the operator may sit.

10. A watercraft comprised of a main hull as set forth in claim 9 wherein there are seats on opposite sides of the berthing area and an operator may control the controls of the small watercraft from either seat.

11. A watercraft comprised of a main hull as set forth in claim 10 wherein the passenger compartment defines a generally u-shaped configuration in top plan view and further including a bench seat extending across the front of the berthing area in the passenger compartment.

12. A watercraft comprised of a main hull as set forth in claim 4 further including mounting means detachably affixed to the main hull for mounting an outboard motor for propelling the main hull.

13. A watercraft comprised of a main hull as set forth in claim 12 wherein the mounting means for the outboard motor mounts the outboard motor so that its propulsion device extends through the opening in the main hull berthing area.

14. A watercraft comprised of a main hull as set forth in claim 13 wherein the operator 's station of the main hull passenger compartment is juxtaposed to the means for mounting the outboard motor.

15. A watercraft comprised of a main hull defining a berthing area open through a portion of the main hull for receiving a smaller watercraft having a propulsion device and controls therefore, said propulsion device comprising a jet propulsion unit having a downwardly facing water inlet portion, a passenger compartment defined by said main hull and at least juxtaposed to said berthing area, said berthing area being defined by a lower portion having an opening adapted to be aligned with the water inlet opening of the smaller watercraft when positioned therein for drawing water into the water inlet opening of the propulsion device of the smaller watercraft when in positioned in the main hull for propelling the main hull by means of the smaller watercraft.

16. A watercraft comprised of a main hull as set forth in claim 15 further including seal means carried around the opening of the main hull for sealing with the water inlet opening of the small watercraft jet propulsion unit.

17. A watercraft comprised of a main hull as set forth in claim 15. wherein the small watercraft has a rearwardly opening discharge nozzle with a steering nozzle carried thereby.

18. A watercraft comprised of a main hull as set forth in claim 15 further including a winch carried by the main hull at the forward portion of the berthing area for drawing the small watercraft into the berthing area.

19. A watercraft comprised of a main hull as set forth in claim 15 wherein the area of the lower portion main hull at the front of the berthing area is curved for guiding the smaller watercraft into the berthing area.

20. A watercraft as set forth in claim 19 wherein the lower portion of the main hull is formed by a lower wall of the main hull.

21. A watercraft as set forth in claim 20 wherein the forward portion of the berthing area has a recess to receive the bow of the smaller watercraft when received in the berthing area for retaining the bow of said smaller watercraft in a vertical position.

22. A watercraft as set forth in claim 21 further including means for holding down the rear of the smaller watercraft within the main hull.

23. A watercraft comprised of a main hull as set forth in claim 15 further including mounting means detachably affixed to the main hull for mounting an outboard motor for propelling the main hull.

24. A watercraft comprised of a main hull as set forth in claim 16 wherein the mounting means for the outboard motor mounts the outboard motor so that its propulsion device extends through the opening in the main hull berthing area.

25. A watercraft comprised of a main hull as set forth in claim 15 further including means for holding the water inlet opening of the jet propulsion unit of the small watercraft into engagement with the opening of the main watercraft hull.

26. A watercraft comprised of a main hull devoid of any propulsion device or control therefrom and defining a berthing area opening through a part of said main hull for receiving a smaller watercraft propelled by a jet propulsion unit device and controls therefore, a passenger compartment defined by said main hull and having a portion at least partially juxtaposed to said berthing area on one side thereof, and an operator station positioned in said portion of said passenger compartment and containing means for accommodating an operator seated in a forwardly facing condition, said operator station, said berthing area and the controls of said smaller watercraft when positioned in said berthing area being arranged for direct operation of said controls by an operator seated within said operator station of said main hull passenger compartment while in a forwardly facing condition, said jet propulsion unit of said smaller watercraft having a water inlet portion formed in the hull thereof in a downwardly facing direction said main watercraft having an opening in the lower surface of said berthing area aligned with the water inlet opening of the smaller watercraft when the smaller watercraft is in said berthing area.

27. A watercraft comprised of a main hull as set forth in claim 26 further including seal means carried around the opening of the main hull for sealing with the water inlet opening of the small watercraft jet propulsion unit.

28. A watercraft comprised of a main hull as set forth in claim 27 wherein the small watercraft has a rearwardly opening discharge nozzle with a steering nozzle carried thereby.

29. A watercraft comprised of a main hull as set forth in claim 28 wherein the small watercraft control accessible from the main watercraft passenger compartment comprises a steering control for the steering nozzle of the small watercraft.

30. A watercraft comprised of a main hull as set forth in claim 29 further including a throttle control for a powering internal combustion engine of the small watercraft accessible by the operator in the operator 's area of the main hull passenger compartment.

31. A watercraft comprised of a main hull as set forth in claim 30 wherein there is a seat provided in the main hull passenger compartment where the operator may sit.

32. A watercraft comprised of a main hull as set forth in claim 31 wherein there are seats on opposite sides of the berthing area and an operator may control the controls of the small watercraft from either seat.

33. A watercraft comprised of a main hull as set forth in claim 32 wherein the passenger compartment defines a generally u-shaped configuration in top plan view and further including a bench seat extending across the front of the berthing area in the passenger compartment.

34. A watercraft comprised of a main hull as set forth in claim 26 further including mounting means detachably affixed to the main hull for mounting an outboard motor for propelling the main hull.

35. A watercraft comprised of a main hull as set forth in claim 34 wherein the mounting means for the outboard motor mounts the outboard motor so that is propulsion device extends through the opening in the main hull berthing area.

36. A watercraft comprised of a main hull as set forth in claim 35 wherein the operator 's station of the main hull passenger compartment is juxtaposed to the means for mounting the outboard motor.

37. A watercraft comprised of a main hull defining a berthing area open through a portion of the main hull for receiving a smaller watercraft having a propulsion device and controls therefore, a passenger compartment defined by said main hull and at least juxtaposed to said berthing area and having a plurality of seats, and a removable cover for covering said berthing area, said removable cover being adapted to form a table accessible from said seats and for use in said passenger compartment.

38. A watercraft comprised of a main hull as set forth in claim 37 wherein at least two of the seats are oppositely facing and the table can be positioned there between.

39. A watercraft comprised of a main hull devoid of any propulsion device or control therefrom and defining a berthing area opening through a part of said main hull for receiving a smaller watercraft having a propulsion device and controls therefore, a passenger compartment defined by said main hull and having a portion at least partially juxtaposed to said berthing area on one side thereof, and an operator station position in said portion of said passenger compartment and containing means for accommodating an operator seated in a forwardly facing condition, said operator station, said berthing area, and the controls of said smaller watercraft when positioned in said berthing area being arranged for directed operation of said controls by an operator seated within said operator station of said main hull passenger compartment while in a forwardly facing condition, said operator station being characterized by an area having a floor and a seat cushion supported upon said floor and adjacent said berthing area to receive an operator seated on said seat cushion with his feet on said floor, a sidewall forming a side of said berthing area and extending vertically above and terminating below said seat cushion.

40. A watercraft as set forth in claim 39, further including a seat back position to the rear of said seat cushion.

* * * * *

UNITED STATES PATENT AND TRADEMARK OFFICE

CERTIFICATE OF CORRECTION

PATENT NO. : 5,775,250
DATED : July 7, 1998
INVENTOR(S) : Kobayashi et al.

It is certified that error appears in the above-identified patent and that said Letters Patent is hereby corrected as shown below:

Column 12,
Line 37, please change "above and terminating" to -- above said floor and terminating --.

Signed and Sealed this

Fifteenth Day of October, 2002

*Attest:*

*Attesting Officer*

JAMES E. ROGAN
*Director of the United States Patent and Trademark Office*